US010870567B2

(12) United States Patent
Peirsman et al.

(10) Patent No.: US 10,870,567 B2
(45) Date of Patent: Dec. 22, 2020

(54) DISPENSING APPLIANCE PROVIDED WITH A DISPOSABLE COOLING CARTRIDGE

(71) Applicant: Anheuser-Busch InBev S.A., Brussels (BE)

(72) Inventors: Daniel Peirsman, Leuven (BE); Stijn Vandekerckhove, Leuven (BE)

(73) Assignee: Anheuser-Busch InBev S.A., Brussels (BE)

( * ) Notice: Subject to any disclaimer, the term of this patent is extended or adjusted under 35 U.S.C. 154(b) by 120 days.

(21) Appl. No.: 16/300,496

(22) PCT Filed: May 12, 2017

(86) PCT No.: PCT/EP2017/061459
§ 371 (c)(1),
(2) Date: Nov. 9, 2018

(87) PCT Pub. No.: WO2017/194736
PCT Pub. Date: Nov. 16, 2017

(65) Prior Publication Data

US 2019/0144253 A1 May 16, 2019

(30) Foreign Application Priority Data

May 13, 2016 (EP) ..... 16169667

(51) Int. Cl.
*B67D 1/08* (2006.01)
*F28F 3/14* (2006.01)
(Continued)

(52) U.S. Cl.
CPC ..... *B67D 1/0862* (2013.01); *B67D 1/0857* (2013.01); *F25D 31/001* (2013.01);
(Continued)

(58) Field of Classification Search
CPC .. B67D 1/0857; B67D 1/0858; B67D 1/0861; B67D 1/0862; B67D 2210/00034;
(Continued)

(56) References Cited

U.S. PATENT DOCUMENTS 4,237,971 A * 12/1980 Olsson ..... F24S 10/753 165/171
4,412,373 A * 11/1983 Kosonen ..... B21D 53/045 29/421.1
(Continued)

FOREIGN PATENT DOCUMENTS

DE 102006005381 7/2006
EP 1 188 995 3/2002
(Continued)

*Primary Examiner* — Patrick M. Buechner
(74) *Attorney, Agent, or Firm* — Levy & Grandinetti

(57) ABSTRACT

A beverage dispensing apparatus having a container containing a beverage and a dispensing tube having three sections. The first section is a cartridge formed by a frame defining a perimeter of an inner area and supporting in the inner area a channel forming a serpentine. An upstream dispensing tube section fluidly connects the interior of the container to an inlet of the channel. A downstream dispensing tube section fluidly connects an outlet of the channel to a tapping valve. The appliance is provided with a cooling unit having a first and second cooling plates separated from one another by a distance defining an insertion slot. The distance separating the cooling plates can be varied, from a loading distance, d0, allowing the introduction of the cartridge into the slot, to a cooling distance, dc<d0, where the cooling plates contact the channel and apply pressure thereon deforming the channel.

11 Claims, 5 Drawing Sheets

(51) Int. Cl.

| | |
|---|---|
| ***F28F 21/08*** | (2006.01) |
| ***F25D 31/00*** | (2006.01) |
| *F28D 21/00* | (2006.01) |
| *B67D 1/04* | (2006.01) |

(52) U.S. Cl.
CPC ..... *F25D 31/002* (2013.01); *F28F 3/14* (2013.01); *F28F 21/08* (2013.01); *B67D 1/0406* (2013.01); *B67D 2210/00028* (2013.01); *B67D 2210/00034* (2013.01); *F25D 2331/802* (2013.01); *F28D 2021/0042* (2013.01); *F28F 2255/10* (2013.01)

(58) Field of Classification Search
CPC ..... B67D 2210/00028; B67D 1/0406; F28F 3/14; F28F 21/08; F28F 2255/10; F25D 31/001; F25D 31/002; F25D 2331/802; F25D 31/00; F28D 2021/0042
See application file for complete search history.

(56) References Cited

U.S. PATENT DOCUMENTS

| | | | | |
|---|---|---|---|---|
| 4,678,027 | A * | 7/1987 | Shirey | F25B 39/04 165/170 |
| 4,687,053 | A * | 8/1987 | Paulus | B21D 53/045 165/133 |
| 4,859,265 | A * | 8/1989 | Shuster | B29C 66/723 156/292 |
| 4,901,887 | A * | 2/1990 | Burton | B67D 1/0858 222/129.1 |
| 5,050,671 | A * | 9/1991 | Fletcher | F28D 1/0308 165/166 |
| 5,129,552 | A * | 7/1992 | Painchaud | B67D 1/06 222/146.6 |
| 5,634,343 | A | 6/1997 | Baker, III | |
| 6,658,859 | B2 | 12/2003 | Phelps et al. | |
| 7,243,703 | B2 * | 7/2007 | Yamaguchi | F28F 3/14 165/41 |
| 7,861,892 | B1 * | 1/2011 | White | B67D 1/06 222/108 |
| 2014/0124187 | A1 * | 5/2014 | Albalat | F28F 21/08 165/185 |
| 2014/0272006 | A1 | 9/2014 | Schuh et al. | |
| 2014/0272019 | A1 | 9/2014 | Schuh et al. | |
| 2015/0129618 | A1 * | 5/2015 | Peirsman | B67D 1/0412 222/399 |
| 2017/0292781 | A1 * | 10/2017 | Pandeya | F25D 16/00 |
| 2019/0031482 | A1 * | 1/2019 | Barron | B67D 1/0001 |

FOREIGN PATENT DOCUMENTS

| | | |
|---|---|---|
| EP | 1 642 863 | 4/2006 |
| EP | 2 103 565 | 9/2009 |
| EP | 2 889 262 | 7/2015 |
| EP | 2 889 263 | 7/2015 |
| EP | 2 889 264 | 7/2015 |
| EP | 3 000 778 | 3/2016 |
| JP | 2002-46799 | 2/2002 |
| WO | WO 87/07361 | 12/1987 |
| WO | WO 2004/051163 | 6/2004 |
| WO | WO 2007/076584 | 7/2007 |
| WO | WO 2010/035302 | 4/2010 |
| WO | WO 2010/064191 | 6/2010 |
| WO | WO 2016/014729 | 1/2016 |

* cited by examiner (a) (b)

DISPENSING APPLIANCE PROVIDED WITH A DISPOSABLE COOLING CARTRIDGE

TECHNICAL FIELD

The present invention concerns a dispensing appliance of the type found in pubs and bars for dispensing a liquid, typically a beverage such as a beer or other carbonated beverages which are to be served at a low temperature. In particular, the dispensing appliance of the present invention is provided with a dispensable cooling cartridge which can be engaged into a cooling unit and thus form a section of a dispensing tube which is in thermal contact with cooling plates mounted in the cooling unit.

BACKGROUND OF THE INVENTION

Many applications require the cooling of a liquid. In particular, beverages must often be cooled prior to or upon dispensing. This is the case of malt based beverages, such as beer, or any soda. There are basically two ways of serving a beverage at a temperature substantially lower than room temperature: either the whole container containing the beverage to be dispensed is cooled, or only the volume of beverage flowing through a dispensing tube from the container to a tapping valve is cooled.

Many beverage dispensers comprise a cooled compartment for storing and cooling a container. A common cooling system is based on the compression-expansion of a refrigerant gas of the type used in household refrigerators. Thermoelectric cooling systems using the Peltier effect have also been proposed in the art for cooling a container stored in a dispensing appliance. One disadvantage of cooling the whole container is that when an empty container must be replaced by a new one, it takes considerable time to bring the content of the new container down to the desired low temperature. A solution to this problem is of course to constantly store a full container in a cooled compartment so that it can be used immediately after being loaded into a dispensing appliance in replacement of an empty container. This solution, however, requires the investment of an additional cooling compartment for storing cooled containers in the wait of being loaded, and requires extra work to store a new container into the cooled compartment after having loaded a new cooled container onto the dispensing appliance.

Cooling only the volume of beverage flowing through the dispensing tube clearly has many potential advantages: no need to pre-cool a container in reserve as discussed supra, the volume of liquid being cooled is restricted to the volume being dispensed, etc. These advantages are, however, difficult to attain, because of the numerous challenges of such process. It must be taken into consideration that the dispensing tube must be cleaned or changed at regular intervals, either because the type of beverage (type of beer) changes from one container to the other, or because with time bacterial deposits may form in a dispensing tube. Another challenge is that beer must be dispensed at a relatively high flow rate, of typically 2 oz/s or 3.5 l/min, and it is difficult to extract all the thermal energy required to bring the temperature of the beverage to the desired value at such flow rates.

Traditionally, the dispensing tube of a dispensing appliance bringing in fluid communication the interior of a container with a tapping valve comprises a serpentine or coil dipped into a vessel of iced water or any other secondary refrigerant such as glycol. Although simple and efficient, this solution has several drawbacks. A vessel of iced water occupies a substantial space which is often scarce behind a bar counter. The temperature of the iced water is limited to zero degree Celsius (0° C.). The level of ice and water must be controlled and ice refilled at regular intervals. A compressor can be used to form ice, so that the vessel needs not be refilled. Subzero temperatures can be reached with e.g., glycol. Furthermore, the coil or serpentine is usually made of copper or other heat conductive metal and must be cleaned at regular intervals, which is not easy in view of the coiled geometry of the serpentine.

The dispensing tube used for dispensing a beverage out of the container may be cooled by contacting it with cooling systems using the Peltier effect. Although not as efficient as other cooling systems, thermoelectric cooling systems have the great advantage of not requiring any refrigerant gas, nor any source of cold refrigerant liquid and only require to be plugged to a source of power. Examples of beverage dispensing appliances comprising a thermoelectric cooling system are disclosed in EP1188995. EP2103565, DE1020060053, U.S. Pat. Nos. 6,658,859, 5,634,343, WO2007076584, WO8707361, WO2004051163, EP1642863. For example, a dispensing appliance comprising a Peltier or thermoelectric cooling system for cooling a section of a dispensing tube is disclosed e.g., in WO2010064191. A dispensing tube comprises a section of deformable walls disposed in a passage extending through a cooling block cooled by a Peltier cooling system. The deformability of the material of the disposable tube is such that the outer surface of the wall of the tube abuts against the inner surface of said passage when the beverage is pressurized. This ensures a better thermal contact between the cooling block and the dispensing tube. The passage through the cooling blocks comprises successive chambers separated from one another by thin passages. The thermal contact area between the dispensing tube and the cooling block is quite reduced and it seems unlikely that satisfactory results could be obtained at flow rates of the order of 3.5 l/min. This is probably the reason why this cooling system is described with respect to domestic beverage dispensing devices only, which function at lower flow rates than in pubs and bars.

Other cooling solutions have been proposed in the art to cool beer flowing through a dispensing tube. For example, JP2002046799 discloses a domestic beverage dispensing device comprising a detachable cooling means placed in tight contact with a flexible dispensing tube, so as to allow the beer supplied from the barrel to be cooled and supplied at an appropriate temperature. The cooling means comprises a gelatinous cold-insulation agent filled in a predetermined container. In addition, a wall surface of the cooling member is formed with a guide for placing the flexible dispensing tube.

There therefore remains a need for a cooling system suitable for cooling beer flowing through a dispensing tube at high rates as used in pubs and bars. The present invention proposes a solution to this need, with a user friendly system, requiring no skills to install and of easy maintenance since the elements in contact with the beverage are disposable. These and other advantages of the present invention are presented in continuation.

SUMMARY OF THE INVENTION

The present invention is defined in the appended independent claims. Preferred embodiments are defined in the dependent claims. In particular, the present invention concerns a kit of parts for a beverage dispensing apparatus. The kit of parts comprises the following components:

(A) A cartridge formed by a frame defining a perimeter of an inner area and supporting in said inner area a channel forming a serpentine extending in a non-rectilinear trajectory from a channel inlet to a channel outlet, both channel inlet and channel outlet being located outside of the inner area, wherein said channel is flexible at least in a radial direction, and (B) An upstream dispensing tube section, comprising an upstream proximal end and an upstream distal end, wherein the upstream distal end is or can be sealingly coupled to the channel inlet, and the upstream proximal end can be brought in fluid communication with the interior of a container;

(C) A downstream dispensing tube section, comprising a downstream proximal end and a downstream distal end, wherein the downstream proximal end is or can be sealingly coupled to the channel outlet, such that, (D) when the upstream distal end is sealingly coupled to the channel inlet and the downstream proximal end is sealingly coupled to the channel outlet, a continuous dispensing tube is formed by the upstream dispensing tube section, the channel, and the downstream dispensing tube section extending from the upstream proximal end to the downstream distal end, (E) A beverage dispensing appliance provided with a cooling unit comprising:

(a) A first cooling plate comprising a first surface and a second cooling plate comprising a second surface facing the first surface, both first and second cooling plates having a perimeter inscribed within the perimeter of the inner area, and (b) a cold source suitable for cooling said first and second surfaces, Characterized in that, the distance separating the first surface and second surface of the first and second cooling plates can be varied, from a loading distance, d0, greater than a thickness of the cartridge and forming an insertion slot allowing the introduction of the cartridge between the two cooling plates, to a cooling distance, dc<d0, wherein the first and second surfaces contact the channel and apply a pressure thereon deforming the channel in the hoop direction.

In preferred embodiment, the channel is formed by a pouch forming an inner space comprised between two polymeric or metallic thin film material defining a sealed perimeter formed by welding or gluing sheet material together, allowing the channel inlet and the channel outlet to bring said inner space in fluid communication with an outer atmosphere, and wherein the non-rectilinear trajectory of the channel is formed by locally gluing or welding sections of the two thin sheets together to define a channel forming a serpentine and comprised within the sealed perimeter. If the pouch is made of metal sheets, the channel is preferably formed by hydro-forming. Alternatively, the sheets can be made of a thermoplastic polymer.

The sealed perimeter is preferably defined by four edges, including a first pair of edges which are substantially parallel to one another and have a length, and a second pair of edges which are substantially parallel to one another and have a width, and wherein the serpentine portions are defined by lines comprising portions substantially parallel to the first pair of edges, each of said lines having a length shorter than the length of said first pair of edges, contacting one edge of the second pair of edges, and being arranged in a staggered pattern.

For reasons of hygiene and to ensure that the upstream and downstream dispensing tubes are changed at regular intervals, it is preferred that the upstream dispensing tube section is permanently coupled to the channel inlet and the downstream dispensing tube section is permanently coupled to the channel outlet.

Alternatively, both upstream and downstream dispensing tube sections can be coupled to the cooling unit. The channel inlet and channel outlet protrude out of the frame of the cartridge such that when the cartridge is introduced into the insertion slot, the channel inlet is reversibly coupled to the distal end of the upstream dispensing tube section and, simultaneously, the channel outlet is reversibly coupled to the proximal end of the downstream dispensing tube section.

It is preferred that the first and second cooling plates be each coupled to resilient means such as to apply a pressure thereon which tends to decrease the distance separating the first surface and second surface of the first and second cooling plates.

The cartridge may be composed of:

a first half frame (1Fu) defining the inner area, a second half frame (1Fd) defining the inner area, and a disposable pouch defining the channel (1C), reversibly clamped in place between the first half frame (1Fu) and the second half frame (1Fd).

The kit of parts of the present invention may further a tapping column unit, comprising a dispensing column which is hollow and provided with a tapping valve suitable for receiving the distal end of the downstream dispensing tube section which is inserted through the hollow column, wherein the cooling unit is located upstream from the hollow tapping column. It may further comprise a chamber for storing a container, wherein the cooling unit is fixed to said chamber, which comprises means for passing the downstream dispensing tube section from the inside to the outside of the chamber.

The present invention also concerns a dispensing apparatus comprising the components (A) to (E) defined supra and a container, such that:

(a) A cartridge is inserted in the insertion slot of the cooling unit;

(b) The proximal end of the upstream dispensing tube section (3U) is in fluid communication with the interior of the container;

(c) The distal end of the upstream dispensing tube section is in fluid communication with the channel inlet;

(d) The proximal end of the downstream dispensing tube section is in fluid communication with the channel outlet; and;

(e) The distal end of the downstream dispensing tube section (3D) is in inserted in a tapping valve.

BRIEF DESCRIPTION OF THE FIGURES

For a fuller understanding of the nature of the present invention, reference is made to the following detailed description taken in conjunction with the accompanying drawings in which.

DETAILED DESCRIPTION OF THE INVENTION

Figure 1:
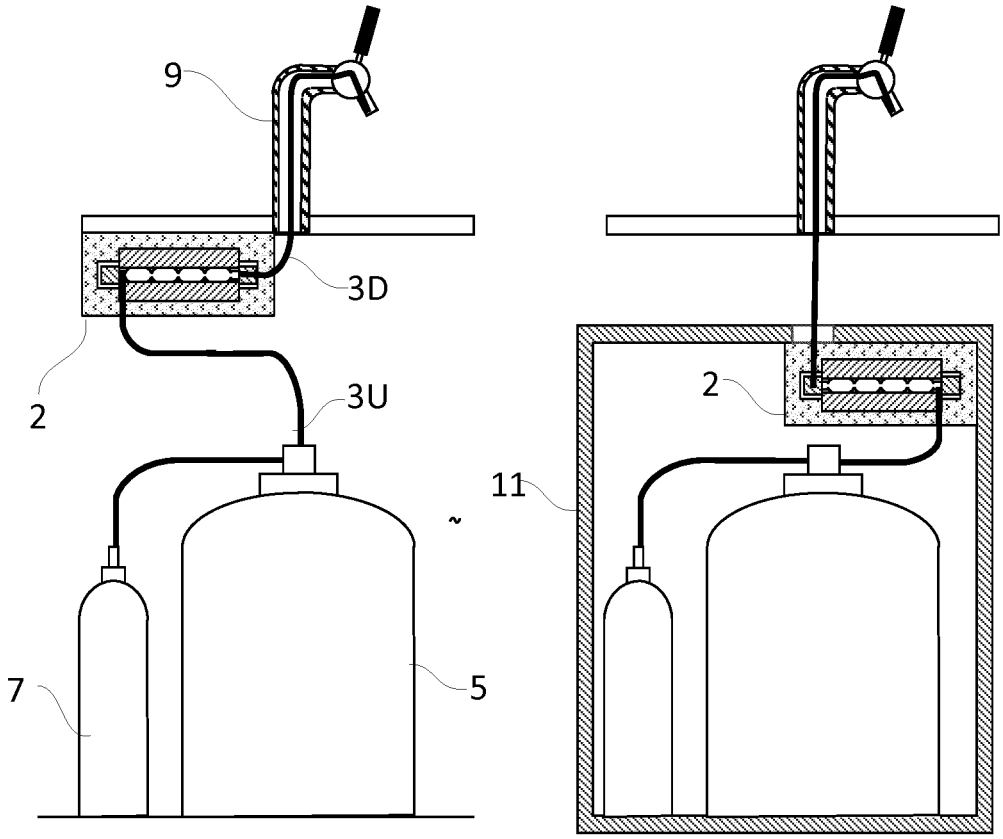
FIG. 1: shows two embodiments of dispensing apparatuses comprising a cooling unit according to the present invention.

As illustrated in FIG. 1, the present invention concerns a beverage dispensing apparatus and a kit of parts for forming such beverage dispensing apparatus comprising the following elements:

- a beverage dispensing appliance provided with a cooling unit (2) comprising a slot defined by the distance separating a first and second surfaces of a first and second cooling plates (2P);
- a cartridge (1) formed by a frame (1F) defining an inner area and supporting in said inner area a channel (1C) forming a serpentine extending from a channel inlet (1*i*) to a channel outlet (1*o*), wherein said channel is flexible at least in one radial direction; the cartridge can fit snugly in the slot of the cooling unit;
- an upstream dispensing tube section (3U) coupled to or suitable for coupling, on the one hand, to a container containing a beverage and, on the other hand, to the channel inlet of the cooling unit, and
- a downstream dispensing tube section (3D) coupled to or suitable for coupling, on the one hand, to the channel outlet of the cooling unit and, on the other hand, to a dispensing tap (9V), provided for example at the top of a dispensing column (9) as traditionally used in pubs.

The foregoing elements will be discussed more in details in continuation. The first and second surfaces of the cooling plates have a geometry and dimensions which are fully inscribed within the inner area of the cartridge. The gist of the invention is that the first and second cooling plates can be moved to vary the distance separating the first and second surfaces from:

- a loading distance, d0, greater than a thickness of the cartridge and forming an insertion slot allowing the introduction of the cartridge between the two cooling plates, to
- a cooling distance, dc<d0, wherein the first and second surfaces contact the channel and apply a pressure thereon deforming the channel in the at least one radial direction.

A channel can be defined by an axial direction, parallel to an axial axis, which defines the trajectory of the channel (which is not necessarily rectilinear). The axial axis often corresponds to an axis of symmetry of the channel or, for non rectilinear channels, is often defined by the succession of points of symmetry put side by side to form a continuous line. A channel is also defined by radial directions, including any direction normal to the axial axis. In a cylindrical channel, the axial axis is the axis of revolution of the cylinder and the radial directions are defined by any radius of a cross-section normal to the axial axis. In the present case, the first and second plates can be moved towards one another such that the first and second surfaces reduce the distance separating them and can thus uniaxially squeeze the channel of the cartridge to improve the contact and increase the contact area between the cooling plates and the channel to enhance heat transfer. The at least one radial direction along which the channel must be flexible is thus defined in use by the moving direction of the first and second cooling plates towards one another.

The cooling unit comprises a cold source (2C) for cooling the first and second cooling plates. Any type of cold source known in the art can be used to cool the first and second cooling plates. Typically compressor based refrigeration systems or thermoelectric cooling systems are well suited for cooling the cooling plates. Any other method can, however, be used without departing from the present invention. The cooling unit is preferably provided with insulation material (2*i*) arranged such as to enhance heat exchange only from the first and second surfaces facing each other and designed to contact the channel of the cartridge.

Figure 2:
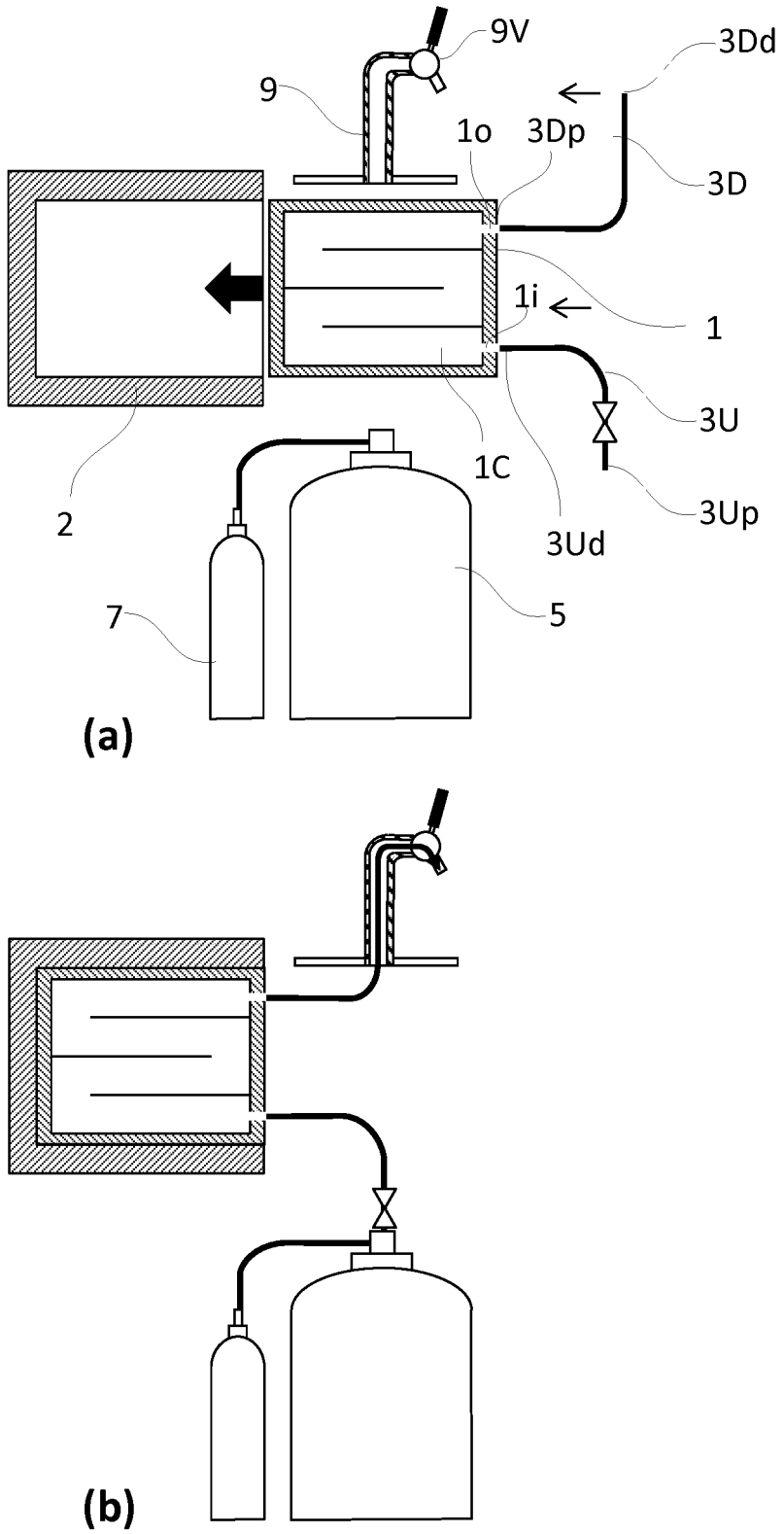
FIG. 2: shows a first embodiment of a dispensing appliance according to the present invention (a) before insertion of the cooling cartridge into an appropriate slot, and (b) with the cooling cartridge in cooling position.
Figure 3:
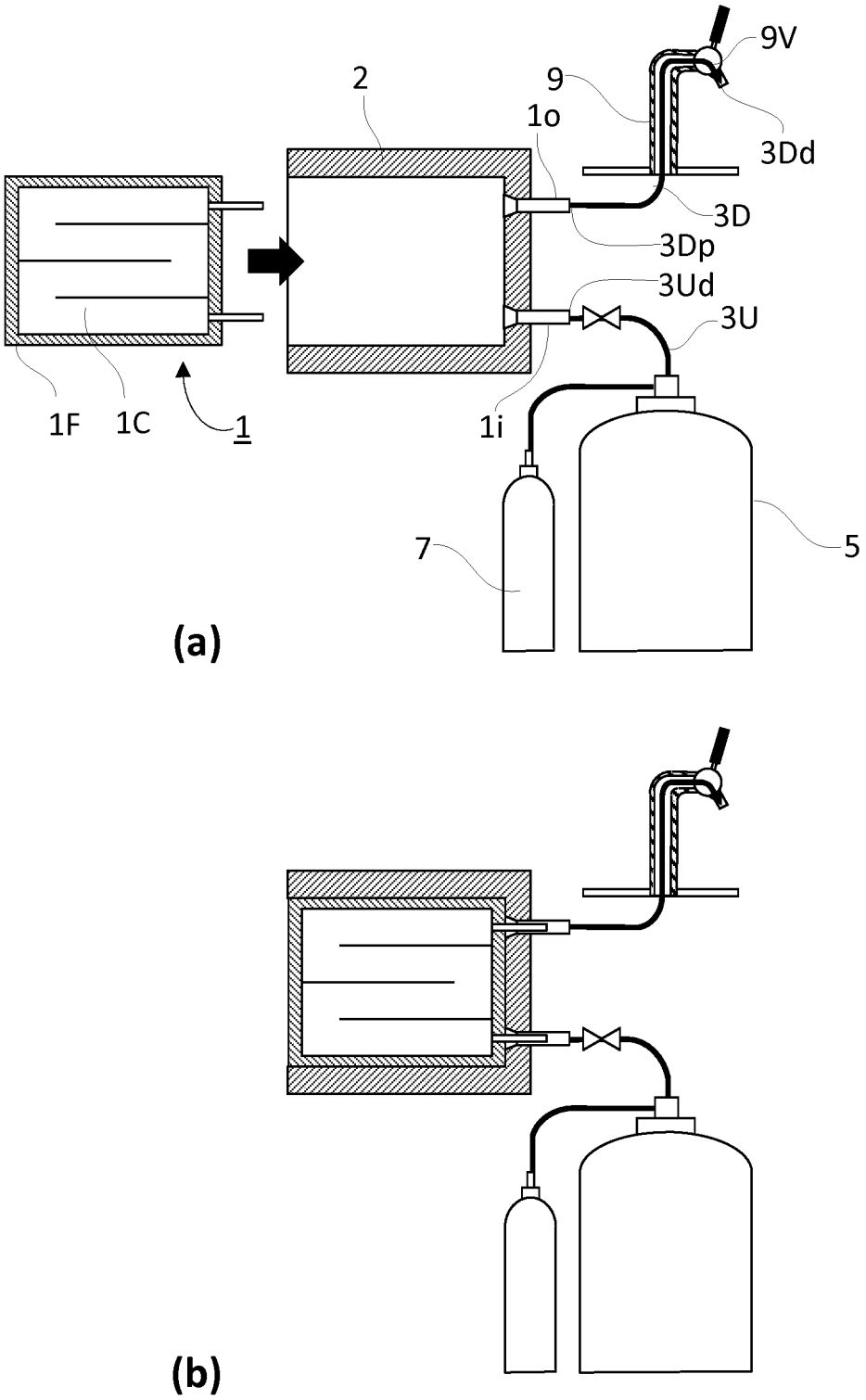
FIG. 3: shows an alternative embodiment of a dispensing appliance according to the present invention (a) before insertion of the cooling cartridge into an appropriate slot, and (b) with the cooling cartridge in cooling position.

As can be appreciated in FIGS. 2&3, a dispensing tube running continuously from a beverage keg or container (5) to a dispensing tap (9V) is composed of three sections:

(a) An upstream dispensing tube section (3U) comprising an upstream proximal end (3Up) which can be coupled to the container and brought in fluid communication with the interior thereof, and an upstream distal end (3Ud) which is or can be sealingly coupled to the channel inlet (1*i*) of the cartridge;

(b) the channel of the cartridge forming a serpentine extending in a non-rectilinear trajectory from a channel inlet—coupled to or suitable for being coupled to the upstream distal end (3Ud)—to a channel outlet, and (c) a downstream dispensing tube section (3D) comprising a downstream proximal end (3Dp) coupled to or suitable for coupling to the channel outlet (1*o*), and a downstream distal end (3Dd), which can be coupled to the dispensing tap (9V).

The terms "upstream" and "downstream" are defined herein with respect to the flow direction of the beverage from a container to a tapping valve, i.e., from the upstream proximal end (3Up) to the downstream distal end (3Dd).

One or more valves may be provided in any of the foregoing three sections. At least a valve may be advantageous at the time of coupling the upstream proximal end (3Up) to the keg before the downstream distal end (3Dd) is correctly coupled to the dispensing tap (9V) and the latter is closed, to prevent undesired and uncontrolled spilling of the beverage. The valve may also be provided on the keg itself or on the coupling ring used for coupling the dispensing tube to the keg. Strictly speaking, a valve is not essential since if the downstream dispensing tube section (3D) is coupled to the dispensing tap (9V) before coupling the upstream dispensing tube section (3U) to the keg, no spilling can occur. A valve is, however, advantageous as a fool proof measure, considering that kegs in a pub may be handled by unexperienced staff or in stressful conditions of noise, crowd, hurry, etc.

For hygiene reasons, as well as for clearly separating the tastes when two kegs containing different beverages are mounted successively to a same dispensing appliance, it is preferred when the whole dispensing tube (i.e., composed of the three sections described above) be disposable. It is therefore preferred to use materials which are cheap, recyclable, and preferably similar for manufacturing the various components of the dispensing tube: upstream and downstream dispensing tube sections and cartridge channel.

Figure 5:
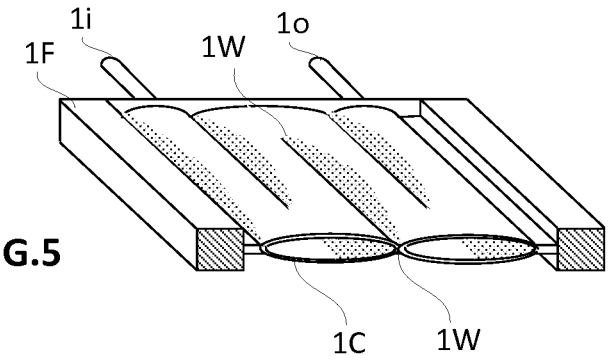
FIG. 5: shows a perspective cut view of an embodiment of cooling cartridge.
Figure 6:
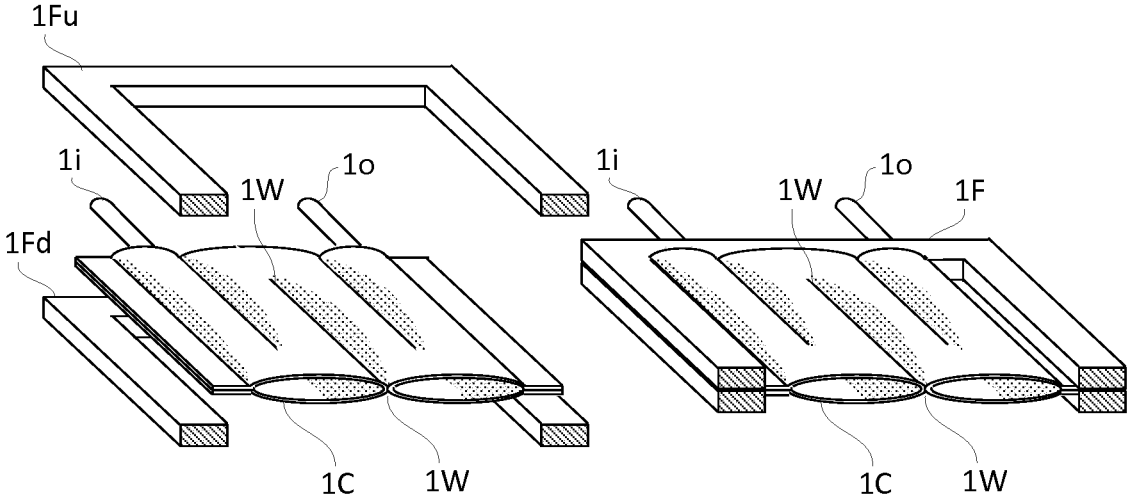
FIG. 6: shows a perspective cut view of an embodiment of cooling cartridge wherein a disposable channel is clamped into a re-usable frame, (a) before and (b) after clamping.

Cartridges suitable for the present invention are illustrated in FIGS. 5 and 6. The channel (1C) can be formed by a pouch forming an inner space comprised between two polymeric or metallic thin film material defining a sealed perimeter formed by welding or gluing sheet material together, allowing the channel inlet and the channel outlet to bring said inner space in fluid communication with an outer atmosphere. The non-rectilinear or tortuous trajectory of the channel is formed by locally gluing or welding sections of the two thin sheets together to define a channel forming a serpentine trajectory of the channel extending from a channel inlet (1*i*) to a channel outlet (1*o*). The pouch is stretched and held within a relatively rigid frame (1F), with the channel inlet and outlet protruding out of the frame. The frame is required to ensure a minimal stiffness to the cartridge. In case a pouch, in particular made of metal sheets, is stiff enough to be inserted into a slot, then the frame becomes optional.

An outer atmosphere is herein defined as any medium being outside of the inner space. If a pouch is isolated, an outer atmosphere would be the ambient atmosphere. In case the channel inlet and outlet of the channel (1F) are sealingly coupled to an upstream and downstream dispensing tube sections (3U, 3D), respectively, then an outer atmosphere can be the atmosphere reigning in the upstream and downstream dispensing tube sections (3U, 3D). They could be filled with a beverage thus forming an outer atmosphere with respect to the interior of the pouch.

In a preferred embodiment, the sealed perimeter of a pouch is defined by four edges, including a first pair of edges which are substantially parallel to one another and have a length, and a second pair of edges which are substantially parallel to one another, have a width, and are preferably substantially normal to the first pair of edges, thus defining a parallelogram or, preferably, a rectangle or square. As shown in FIGS. 2, 3, 5 and 6, the tortuous channel (1C) forming a serpentine can be formed by sealed lines (1W) extending substantially parallel to the first pair of edges, each of said sealed lines having a length shorter than the length of said first pair of edges, contacting one edge of the second pair of edges, and being arranged in a staggered pattern. As discussed earlier, the sealed lines can be formed by welding, brazing, or gluing together the two thin films forming the pouch.

In a preferred embodiment, the pouch forming the channel (1C) is disposable and the frame is re-usable. After each keg or after a number of kegs have been emptied, the pouch can be changed with a new one by clamping it between two half frames (1Fd, 1Fu) as shown in FIG. 6. The pouch can be made of metal, such as aluminium or steel or, preferably, of a polymer, such as a polyolefin (polyethylene, polypropylene, etc.) or any thermoplastic polymer suitable for such use. A thermoplastic polymer such as a polyolefin is preferred because the upstream and downstream dispensing tube sections (3U, 3D) can be made of the same material, thus requiring no sorting of the different sections (1, 3D, 3U) of a spent dispensing tube.

A metal pouch comprising a tortuous channel can be formed byhydro-forming. Hydroforming is a specialized type of die forming that uses a high pressure hydraulic fluid to press room temperature working material into a die. To hydroform ductile metals such as aluminium, brass, low alloy steel, or stainless steel into a tortuous channel defined within a pouch, a hollow metal tube is placed inside a negative mould that has the shape of the desired result. High pressure hydraulic pumps then inject fluid at very high pressure inside the metal tube which causes it to expand until it matches the mould. The hydro-formed metal pouch defining a tortuous channel is then removed from the mould.

In an alternative production method, welding lines are formed between two thin stainless steel sheets (e.g., <80 μm) by laser welding or any other welding technique to form a metal pouch with a tortuous channel. Alternative joining methods for the formation of a metal pouch with a tortuous channel include roll bonding or gluing. The flat channels thus formed between two welding lines can be inflated either by injecting a pressurized gas, such as air, or simply by injecting beer under pressure therethrough. A polymeric pouch can, on the other hand, be continuously extruded by methods well known to a person skilled in the art.

In one embodiment, the upstream dispensing tube section is permanently coupled to the channel inlet and, similarly, the downstream dispensing tube section is permanently coupled to the channel outlet. This way, a user is obliged to replace the whole dispensing tube and is not tempted to keep one or the other sections for further use, which could be detrimental to a consumer for hygienic reasons. Such embodiment could be used in an assembly as illustrated in FIG. 2.

In an alternative embodiment, illustrated in FIG. 3, both upstream and downstream dispensing tube sections are reversibly coupled to the cooling unit. A cartridge is provided with channel inlet and channel outlet protruding out of the frame of the cartridge. When the cartridge is introduced into the insertion slot defined between the two cooling plates, the channel inlet (1*i*) is reversibly engaged and coupled to the distal end of the upstream dispensing tube section and, simultaneously, the channel outlet (1*o*) is reversibly coupled to the proximal end of the downstream dispensing tube section. This solution makes it very simple and easy to change a cartridge. It can be very advantageous when using kegs provided with an upstream dispensing tube section permanently coupled to said keg, as sometimes available on the market. There is a risk, however, that a cartridge be changed, but one or both of the upstream and downstream dispensing tube sections (3D, 3U) be left unchanged for a period longer than reasonable for hygiene reasons.

The gist of the present invention is that the distance separating the first surface and second surface of the first and second cooling plates can be varied. This ensures a good contact between the channel (1C) and the cooling plates (2P) so that the heat transfer from the beverage to the cooling plates is optimized. In an embodiment illustrated in FIG. 4, the first and second cooling plates are each coupled to resilient means (2F) such as to apply a pressure thereon which tends to decrease the distance separating the first surface and second surface of the first and second cooling plates.

Figure 4:
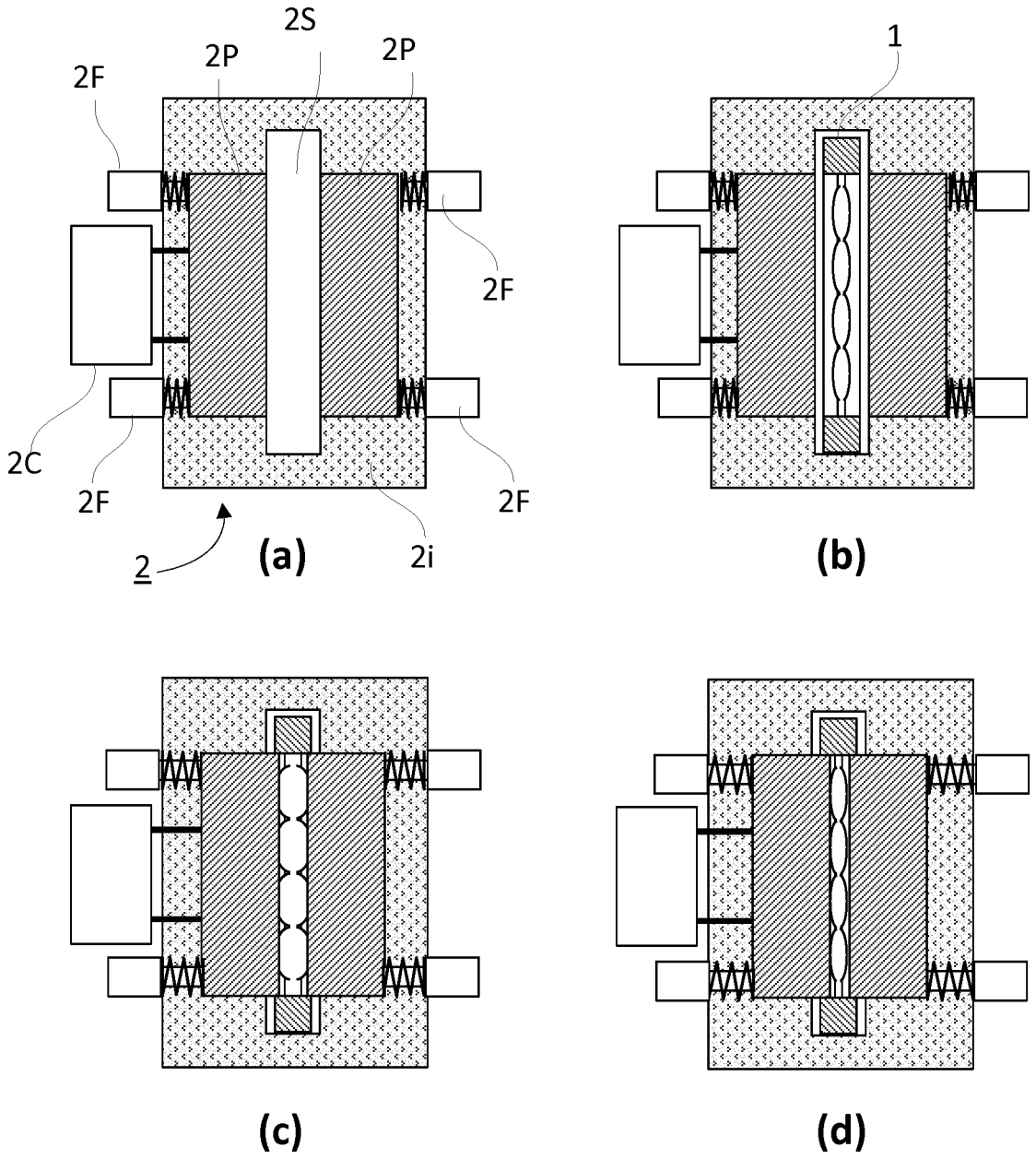
FIG. 4: shows the various steps for loading a cooling cartridge into a cooling unit with (a) the cooling unit with an empty slot ready to receive a cooling cartridge, (b) loading of a cooling cartridge into the slot of the cooling unit, (c) pressurization of the channel and application of a pressure by the moving cooling plates, and (d) pressing of the channel when the container is nearly empty.

As shown in FIGS. 4(*a*) and (*b*), in a loading configuration, the two cooling plates are separated from one another by a loading distance, d0, greater than a thickness of the cartridge and forming an insertion slot (2S). A cartridge (1) can be inserted into said slot as shown in FIG. 4(*b*). When a new cartridge is being inserted, the channel (1C) is generally deflated as the dispensing channel is not yet pressurized at this stage. Upon pressurization of a keg or container after coupling the upstream proximal end (3Up) to the keg, the cartridge channel is inflated and filled with liquid. As shown in FIG. 4(*c*), the cold plates are then allowed to yield to the pressure of the resilient means and the first and second surfaces get closer to one another until they reach a cooling distance, dc, at which they contact the thin films of the pouch forming the tortuous channel (1C). Because both first and second cooling plates have a perimeter inscribed within the perimeter of the inner area defined by the frame, the first and second surfaces can contact directly the surface of the films of the pouch without any hindrance or obstruction from the frame. In a preferred embodiment, the first and second surfaces may comprise a structure mating the surface of the tortuous channel so as to further increase the contact area between the channel and the cooling plates.

As shown in FIG. 4(*d*), when the pressure in the dispensing tube decreases, the flexible channel deflates and the first and second surfaces keep contact with the pouch thin films by getting closer to one another following the volume variations of the flexible channel. The pressure may decrease when the keg is empty or, in some cases, the keg is not constantly pressurized, but only upon dispensing. The advantage of the cooling plates keeping contact with the channel regardless of the volume of the channel is advantageous in that after each dispensing or after a keg got empty; the liquid remaining in the dispensing tube is pressed out from the channel towards the downstream dispensing tube section to the tapping valve, thus emptying a substantial part of the dispensing tube from any remaining liquid.

As shown in FIG. 1(*a*), a cooling unit (2) as defined in the present invention allows to make without any chamber for storing one or more containers, be it refrigerated or not. As illustrated in FIG. 1(*b*), a chamber (11) can of course be used to store one or more kegs (5) coupled to a source of pressurized gas (7), but said chamber needs not be refrigerated. The cooling unit can be fixed to a wall of said chamber, which comprises means for passing the downstream dispensing tube section from the inside to the outside of the chamber, to a tapping column and a tapping valve. Besides the fact that a newly coupled keg can be served immediately, without waiting for the whole volume of beverage contained therein to reach the serving temperature, the present invention also allows a reduction of the investment required for home and pubs appliances alike, since no cooling chamber is required for serving a chilled beverage. As discussed above, a cartridge can be very cheap and cooling becomes very easy and economical with the present invention.

In use, all the components described supra are assembled to form a beverage dispensing apparatus comprising a container containing a beverage, and further comprising:

(A) A cartridge (1) as defined supra, with (B) An upstream dispensing tube section (3U) with the upstream distal end thereof sealingly coupled to the channel inlet, and with the upstream proximal end thereof coupled to the container, in fluid communication with the interior of said container;

(C) A downstream dispensing tube section (3D), with the downstream proximal end (3Dp) thereof sealingly coupled to the channel outlet and with the downstream distal end (3Dd) thereof coupled to a tapping valve (9V), (D) a continuous dispensing tube being thus formed by the upstream dispensing tube section, the channel, and the downstream dispensing tube section, and (E) A beverage dispensing appliance provided with a cooling unit as defined supra, i.e., comprising two cooling plates separated by a slot (2S) for receiving a cartridge. The dispensing appliance preferably but not necessarily comprises a chamber (11) for storing one or more beverage containers and at least one source of pressurized gas.

The cartridge is inserted in the insertion slot (2S) of the cooling unit (2). A continuous dispensing tube runs from the upstream proximal end (3Up) in fluid communication with the interior of the container to the downstream distal end (3Dd) coupled to the tapping valve and opening to the ambient atmosphere. The beverage being dispensed is cooled as it flows through the tortuous channel of the cartridge by exchanging heat with the first and second surfaces of the first and second cooling plates in intimate thermal contact with the thin walls of the channel. A cold or chilled beverage can thus be served without having to cool the whole content of the container.

| REF | DESCRIPTION |
|---|---|
| 1 | cartridge |
| 1C | channel |
| 1F | Frame of the cartridge |
| 1i | Channel inlet |
| 1o | Channel outlet |
| 1W | Welding lines defining channel |
| 2 | Cooling unit |
| 2C | Source of cold |
| 2F | Resilient means for applying pressure onto cooling plates |
| 2i | Insulation of cooling unit |
| 2P | Cooling plates |
| 2S | Insertion slot |
| 3D | Downstream dispensing tube section |
| 3Dd | Distal end of downstream dispensing tube section |
| 3Dp | Proximal end of downstream dispensing tube section |
| 3P | upstream dispensing tube section |
| 3PD | Distal end of upstream dispensing tube section |
| 3Pp | Proximal end of upstream dispensing tube section |
| 5 | Container or keg |
| 7 | Source of pressurized gas |
| 9 | Dispensing column |
| 9V | Dispensing valve |
| 11 | Compartment for container |

The invention claimed is:

1. A kit of parts for a beverage dispensing apparatus, said kit of parts comprising the following components:

(A) a cartridge formed by a frame defining a perimeter of an inner area and supporting in said inner area a channel forming a serpentine extending in a non-rectilinear trajectory from a channel inlet to a channel outlet, both channel inlet and channel outlet being located outside of the inner area, wherein said channel is flexible at least in a radial direction, and (B) an upstream dispensing tube section, comprising an upstream proximal end and an upstream distal end, wherein the upstream distal end is or can be sealingly coupled to the channel inlet, and the upstream proximal end can be brought in fluid communication with the interior of a container;

(C) a downstream dispensing tube section, comprising a downstream proximal end and a downstream distal end, wherein the downstream proximal end is or can be sealingly coupled to the channel outlet, such that, (D) when the upstream distal end is sealingly coupled to the channel inlet and the downstream proximal end is sealingly coupled to the channel outlet, a continuous dispensing tube is formed by the upstream dispensing tube section, the channel, and the downstream dispensing tube section extending from the upstream proximal end to the downstream distal end, and (E) a beverage dispensing appliance provided with a cooling unit comprising:

(c) a first cooling plate comprising a first surface and a second cooling plate comprising a second surface facing the first surface, both first and second cooling plates having a perimeter inscribed within the perimeter of the inner area, and (d) a cold source suitable for cooling said first and second surfaces, wherein a distance separating the first surface and second surface of the first and second cooling plates can be varied, from a loading distance, d0, greater than a thickness of the cartridge and forming an insertion slot allowing the introduction of the cartridge between the two cooling plates, and to a cooling distance, dc<d0, wherein the first and second surfaces contact the channel and apply a pressure thereon deforming the channel in the hoop direction.

2. A kit of parts according to claim 1, wherein the channel is formed by a pouch forming an inner space comprised between two polymeric or metallic thin film material defining a sealed perimeter formed by welding or gluing sheet material together, allowing the channel inlet and the channel outlet to bring said inner space in fluid communication with an outer atmosphere, and wherein the non-rectilinear trajectory of the channel is formed by locally gluing or welding sections of the two thin sheets together to define a channel forming serpentine portions and comprised within the sealed perimeter.

3. A kit of parts according to claim 2, wherein the sheet layers are made of metal and the channel is formed by hydro-forming, or are made of a thermoplastic polymer.

4. A kit of parts according to claim 2, wherein the sealed perimeter is defined by four edges, including a first pair of edges which are substantially parallel to one another and have a length, and a second pair of edges which are substantially parallel to one another and have a width, and wherein the serpentine portions are defined by lines comprising portions substantially parallel to the first pair of edges, each of said lines having a length shorter than the length of said first pair of edges, contacting one edge of the second pair of edges, and being arranged in a staggered pattern.

5. A kit of parts according to claim 1, wherein the upstream dispensing tube section is permanently coupled to the channel inlet and the downstream dispensing tube section is permanently coupled to the channel outlet.

6. A kit of parts according to claim 1, wherein both upstream and downstream dispensing tube sections are coupled to the cooling unit and wherein the channel inlet and channel outlet protrude out of the frame of the cartridge, such that when the cartridge is introduced into the insertion slot, the channel inlet is reversibly coupled to the distal end of the upstream dispensing tube section and, simultaneously, the channel outlet is reversibly coupled to the proximal end of the downstream dispensing tube section.

7. A kit of parts according to claim 1, wherein the first and second cooling plates are each coupled to resilient means such as to apply a pressure thereon which tends to decrease the distance separating the first surface and second surface of the first and second cooling plates.

8. A kit of parts according to claim 1, further comprising a tapping column unit, comprising a dispensing column which is hollow and provided with a tapping valve suitable for receiving the distal end of the downstream dispensing tube section which is inserted through the hollow column, wherein the cooling unit is located upstream from the hollow tapping column.

9. A kit of parts according to claim 1, wherein the cartridge is composed of:

a first half frame defining the inner area, a second half frame defining the inner area, and a disposable pouch defining the channel, reversibly clamped in place between the first half frame and the second half frame.

10. A kit of parts according to claim 1, further comprising a chamber for storing a container, wherein the cooling unit is fixed to said chamber, which comprises means for passing the downstream dispensing tube section from the inside to the outside of the chamber.

11. A beverage dispensing apparatus comprising the components (A) to (E) defined in claim 1 and a container, such that:

(a) A cartridge is inserted in the insertion slot of the cooling unit;

(b) The proximal end of the upstream dispensing tube section is in fluid communication with the interior of the container;

(c) The distal end of the upstream dispensing tube section is in fluid communication with the channel inlet;

(d) The proximal end of the downstream dispensing tube section is in fluid communication with the channel outlet; and (e) The distal end of the downstream dispensing tube section is in inserted in a tapping valve.

* * * * *